US008052441B2

(12) United States Patent
Senatori et al.

(10) Patent No.: US 8,052,441 B2
(45) Date of Patent: Nov. 8, 2011

(54) PLUG MODULE

(75) Inventors: Mark David Senatori, The Woodlands, TX (US); Kevin L. Massaro, Houston, TX (US); Glenn A. Wong, Foster City, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 27 days.

(21) Appl. No.: 12/685,080

(22) Filed: Jan. 11, 2010

(65) Prior Publication Data

US 2011/0171842 A1 Jul. 14, 2011

(51) Int. Cl.
*H01R 29/00* (2006.01)

(52) U.S. Cl. ..... 439/171

(58) Field of Classification Search ..... 439/131, 439/170–175, 221, 518, 956
See application file for complete search history.

(56) References Cited

U.S. PATENT DOCUMENTS

| | | | | |
|---|---|---|---|---|
| 6,247,941 | B1 * | 6/2001 | Lee et al. | 439/105 |
| 6,287,131 | B1 * | 9/2001 | Deng | 439/103 |
| 6,669,495 | B2 | 12/2003 | Philips et al. | |
| 6,942,508 | B2 | 9/2005 | Wong | |
| 6,986,678 | B1 * | 1/2006 | Di-Nardo et al. | 439/372 |
| 7,118,399 | B1 * | 10/2006 | Wen et al. | 439/166 |
| 7,168,969 | B1 | 1/2007 | Wang | |
| 7,192,303 | B2 * | 3/2007 | Kohen | 439/537 |
| 2006/0270250 | A1 * | 11/2006 | Allen | 439/43 |

FOREIGN PATENT DOCUMENTS

WO WO2008/071080 6/2008

* cited by examiner

*Primary Examiner* — Tulsidas C Patel
*Assistant Examiner* — Phuong Nguyen
(74) *Attorney, Agent, or Firm* — Reed Hablinski

(57) ABSTRACT

A system can include a receiver to receive a plug module. The plug module can include multiple apertures located substantially the same distance from an axis of rotation of the plug module. A connector can extend from the receiver to connect to a contact in one of the multiple apertures of the plug module.

20 Claims, 6 Drawing Sheets

PLUG MODULE

BACKGROUND

Receptacles to provide electrical power can come in many different configurations that may include different shapes, sizes and voltages. A plug can have a shape that allows the plug to be inserted into the receptacle. Even if the plug has a shape and size that allows it to be inserted into the receptacle the device receiving power from the receptacles through the plug may be damaged if the voltage at the receptacle is outside of the voltage range that the device can operate on. For example if a device operates on 12 volts direct current and the power adapter converts 110 volts alternating current to 12 volts direct current if the power adapter is connected to a 220 volt receptacle then the power adapter or the device may be damaged by the increase in voltage supplied to the power adapter.

BRIEF DESCRIPTION OF THE DRAWINGS

Some embodiments of the invention are described with respect to the following figures.

DETAILED DESCRIPTION

The power adapters may be of a size that if plugged into a first receptacle that has second receptacles adjacent to the first receptacle the power adapter may prevent the adjacent receptacles from being used. A receptacle may supply different voltages and have different configurations to accept a plug. For example, some areas use 110 volts and some use 220 volts. The different areas may also have different receptacle configuration so that even if the plug is for a 220 volt receptacle in one area it may not connect to a 220 volt receptacle in another area.

For a power adapter to work in different areas the power adapter can include a voltage converter to allow the power adapter to work with both 110 volt systems and 220 volt systems. For a power adapter to work with different receptacle configurations the power adapter may include different plugs that can be attached to the power adapter to allow the power adapter to work with the different receptacles in different locations.

The plugs may be in the form of modules that have different plug configurations. The plug modules can be attached to a receiver before the plug module is inserted in the receptacle. However there is nothing to prevent the plug from being inserted in the receptacle without being attached to the receiver. If the plug module is inserted into a receptacle without the receiver being connected a user may be electrocuted if there are exposed contacts on the plug module when the plug module is inserted in the receptacle.

In one embodiment a plug module that can rotate to different positions to allow adjacent receptacles to be used and still not have exposed contacts that could electrocute the user. In one embodiment the system can include a receiver to receive a plug module. The plug module can include multiple apertures located substantially the same distance from an axis of rotation of the plug module. A receiver connector can extend from the receiver to connect to a contact in one of the multiple apertures of the plug module.

Figure 1:
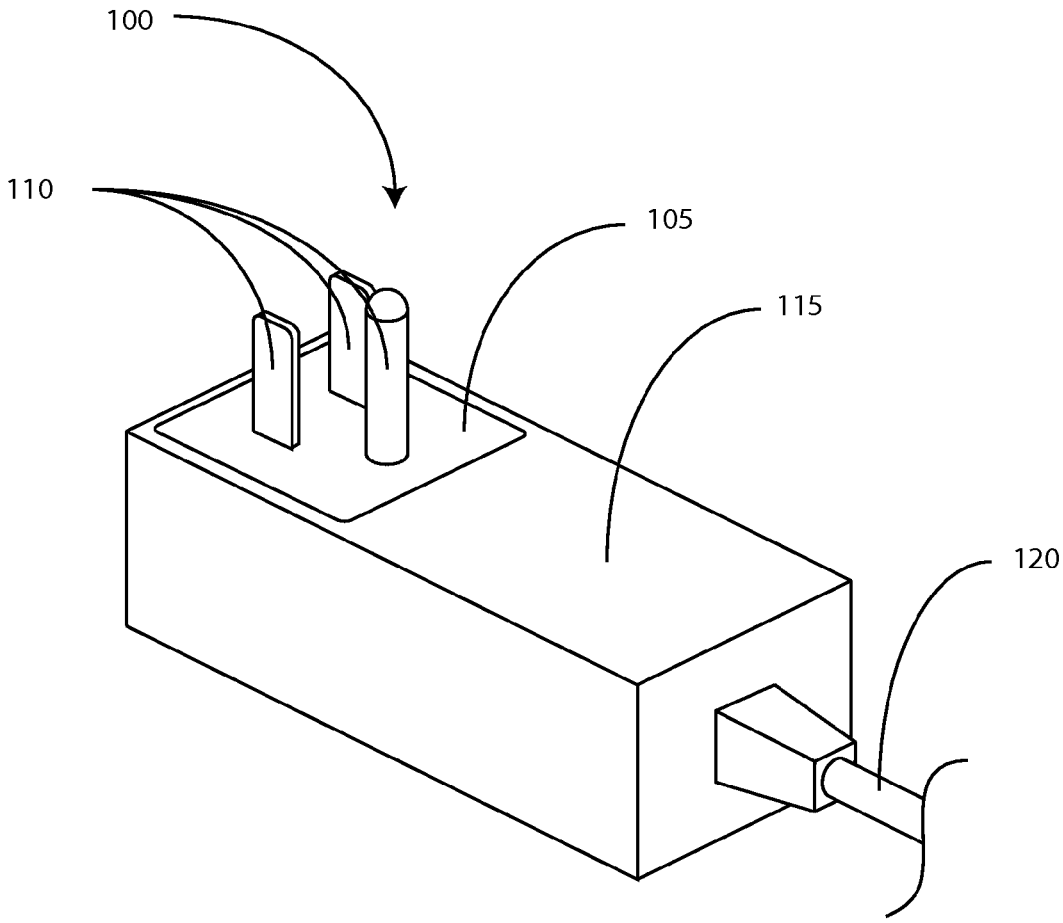
FIG. 1 is a power adapter according to an example embodiment of the invention.

With reference to the figures, FIG. 1 is a power adapter according to an example embodiment of the invention. The power adapter 100 can include a receiver 115. The power adapter 100 can also include a plug module 105. The plug module 105 can have plug connectors 110. The plug connectors 110 can be made of an electrically conductive material for example copper, aluminum, a metal alloy or another electrically conductive material.

The power adapter 100 can include a cord 120 extending from the power adapter 100. The cord 120 can be used to connect the power adapter 100 to a computing device, a peripheral computing device, or any machine that can receive electrical power. The cord 120 may be an electrical cord with power, common and ground conductors. The conductors in the power cord 120 may be separately insulated.

In one embodiment the plug module of the power adapter 100 is inserted into the receiver 115. If the plug module 105 is inserted in the receiver 115 the plug connectors 110 on the plug module 105 may be connected to the conductors in the cord 120 of the power adapter 100.

The power adapter 100 shown in the figure includes a receiver 115 including a rectangular cross section. The receiver 115 and the power adapter 100 can be other shapes in addition to rectangular, for example, round, square, trapezoid, or another polygon. The plug module 105 shown in the figure is square but may be other shapes. In one embodiment the shapes are for example round, octagon, or another shape that may be able to be rotated and be connected to the receiver 115.

Figure 2:
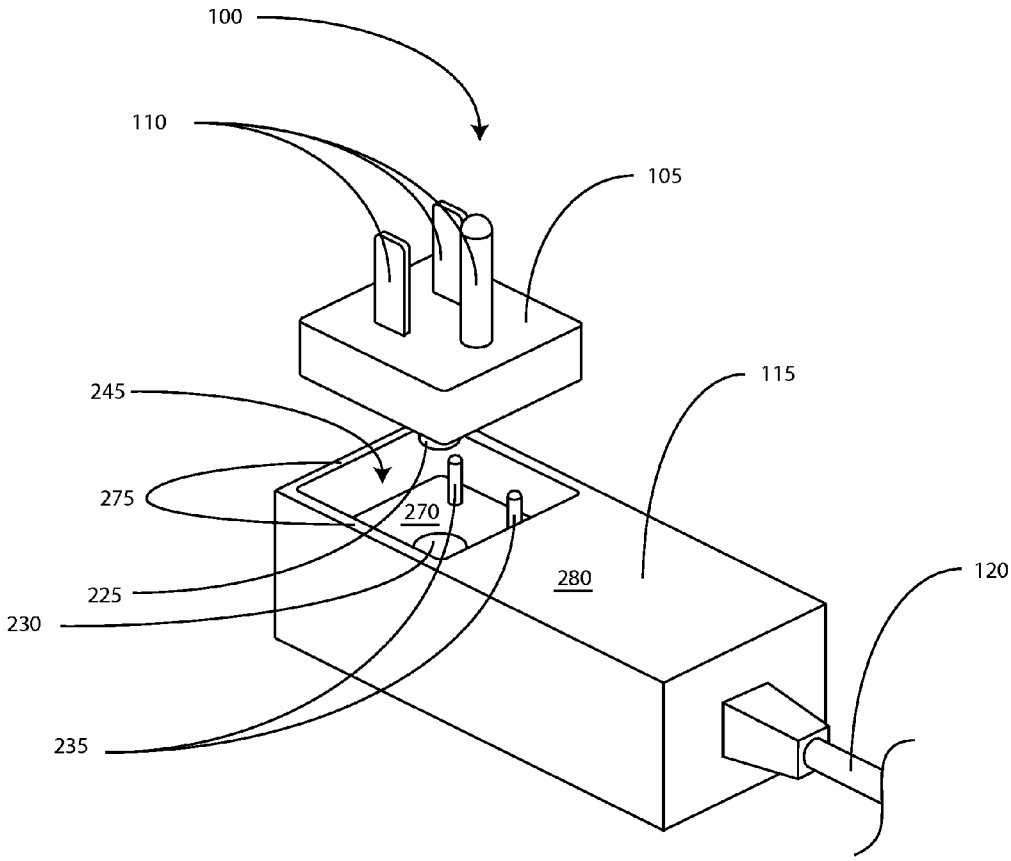
FIG. 2 is a power adapter according to an example embodiment of the invention.

FIG. 2 is a power adapter according to an example embodiment of the invention. The power adapter 200 can have a receiver 115 that may include a cavity 245. The cavity may be defined by a bottom surface 270 and at least one wall 275. If the power adapter includes a cavity 245 the bottom surface 270 of the cavity may include receiver connectors 235. The receiver connectors 235 may extend from the bottom surface 270 of the cavity 245. The receiver connectors 235 may have a circular, oval, rectangular or another cross sectional shape. The receiver connectors 235 may be connected to the conductors in the cord 120. The number of receiver connectors may be dependent on the number of conductors in the cord 120, for example in one embodiment the number of the receiver connectors 235 may be equal to the number of conductors in the cord 120. There may be receiver connectors 235 in the cavity that are not connected to the conductors in the cord 120.

In one embodiment, an opening 230 may be in the bottom surface 270 of the cavity 245. The opening 230 may have a conductor within the side of the opening. The conductor in the side of the opening 230 can be connected to a conductor in the cord 120. The opening 230 may be for receiving a ground connector 225 extending from the plug module 105. The ground connector 225 may be in the middle of the plug module 105. The opening 230 may be in the middle of the bottom surface 270. If the ground connector 225 is in the middle of the plug module 105 and the opening is in the middle of the bottom surface 270 then the plug module may be able to rotate to multiple positions and the ground connector 225 can be received by the opening 230 in each of the positions. For example if the plug module is a square and rotated 90 degrees, 180 degrees, or 270 degrees the ground connector 225 can still be received by the opening 270 if the ground connector 225 and the opening 270 are in the middle of the plug module and the bottom surface 270.

In some embodiments, the bottom surface 270 is not surrounded by the walls and may be for example the surface 280 of the receiver 115. If the bottom surface 270 is not surrounded by a wall 275 then the plug module 105 may be external to the receiver 115. If the plug module 105 is external to the receiver 115 the receiver connectors 235 may extend from the surface 280 of the receiver 115.

In one embodiment the receiver connectors 235 may be for connecting to different plug modules 105. For example a plug module 105 for a 110 volt system may have a different configuration of plug connectors 110 than a plug module 105 for a 220 volt system and a receiver connector 235 may make an electrical connection with one plug module such as the 110 volt plug module but not make a connection with another plug module such as the 220 volt plug module. If the same receiver connectors 235 are used for different plug modules 105 then a voltage converter may be used to change the voltage from a 110 volt to 220 volt or from 220 volt to 110 volt. If at least one of the receiver connectors 235 is not used for either the 110 volt or the 220 volt plug module then a voltage converter may not be used because a power converter for 110 volt or 220 volt can be connected to the receiver connectors 235 that are electrically connected to the plug module 105.

Figure 3:
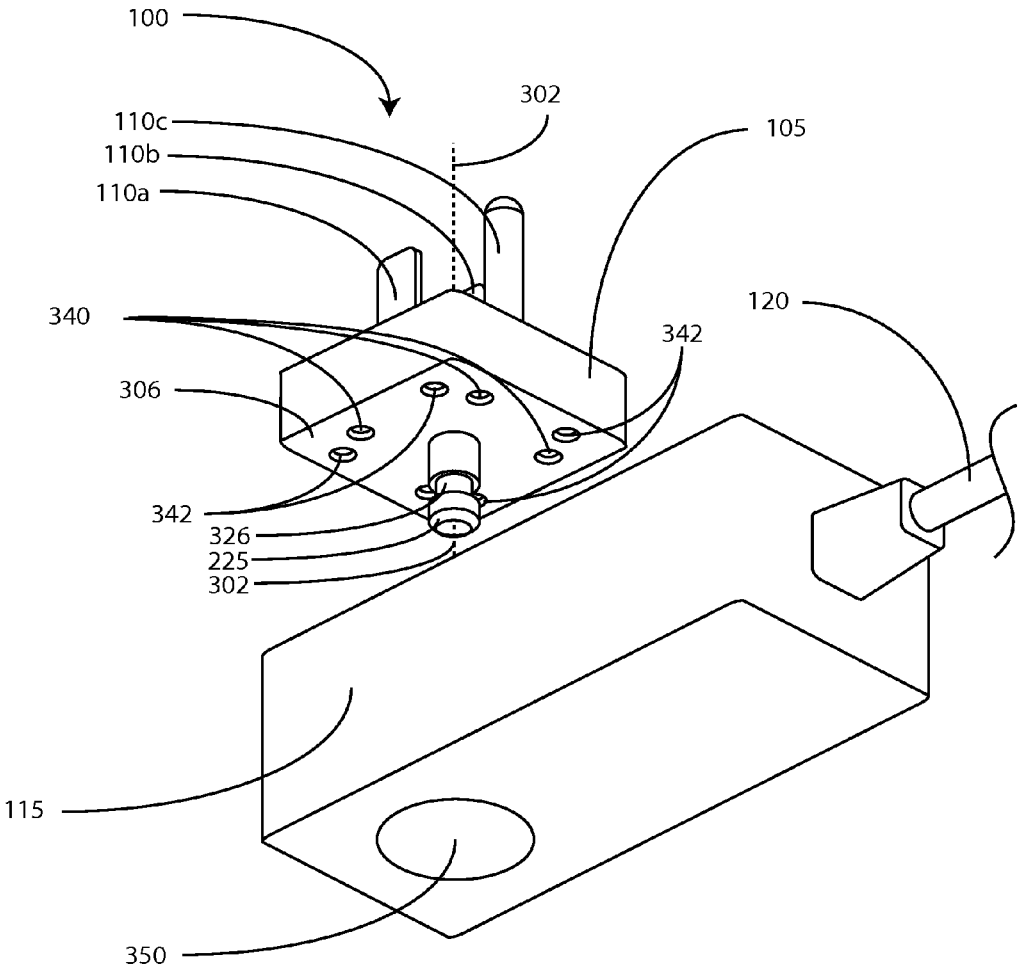
FIG. 3 is a power adapter according to an example embodiment of the invention.

FIG. 3 is a power adapter according to an example embodiment of the invention. The power adapter 100 can include a receiver 115 that accepts the plug module 105. The plug module 105 can have plug connectors 110 that extend from the plug module 105. The plug module may have apertures 340 and 342. The apertures 340 may be electrically connected together and the apertures 342 may be electrically connected together. The apertures 340 and 342 can also be connected to the plug connectors 110*a* and 110*b* for example. In one embodiment a plug connector 110*c* can be electrically connected to the ground connector 225. The plug module may be rotated around an axis 302, for example a center of the plug module 105. In one embodiment the apertures 340 may be substantially the same distance from the axis 302 and the apertures 342 may be substantially the same distance from the axis 302 so that if the plug module is rotated to another position a variation in the distance of the apertures from the axis of rotation does not prevent a receiver connector from being received by the aperture.

In one embodiment the plug adapter includes the apertures on the first side 306 opposite the plug connectors 110*a, b*, and *c* on the second side 307 of the plug module 105. The apertures 340 and 342 can have a conductor inside of the apertures 340 and 342 to connect to the receiver connectors on the receiver 115. The apertures 340 and 342 may have the conductor recessed in the apertures 340 and 342 to prevent a user from being electrocuted by contacting the plug module 105 if the plug connectors 110*a, b*, or *c* are connected to a power source such as an alternating current wall receptacle.

In one embodiment the ground connector 225 includes a fastener 326. The fastener 326 may be for example a notch that may be used to secure the plug module 105 to the receiver 115. In one embodiment the receiver 115 can include a button 350. The button 350 may be located in positions other than where depicted on the receiver 115 and if the button 350 is activated the button 350 can release the connection between the plug module 105 and the receiver 115. In one embodiment the plug module 105 may be prevented from being inserted in the receiver 115 if the button 350 is not activated.

Figure 4:
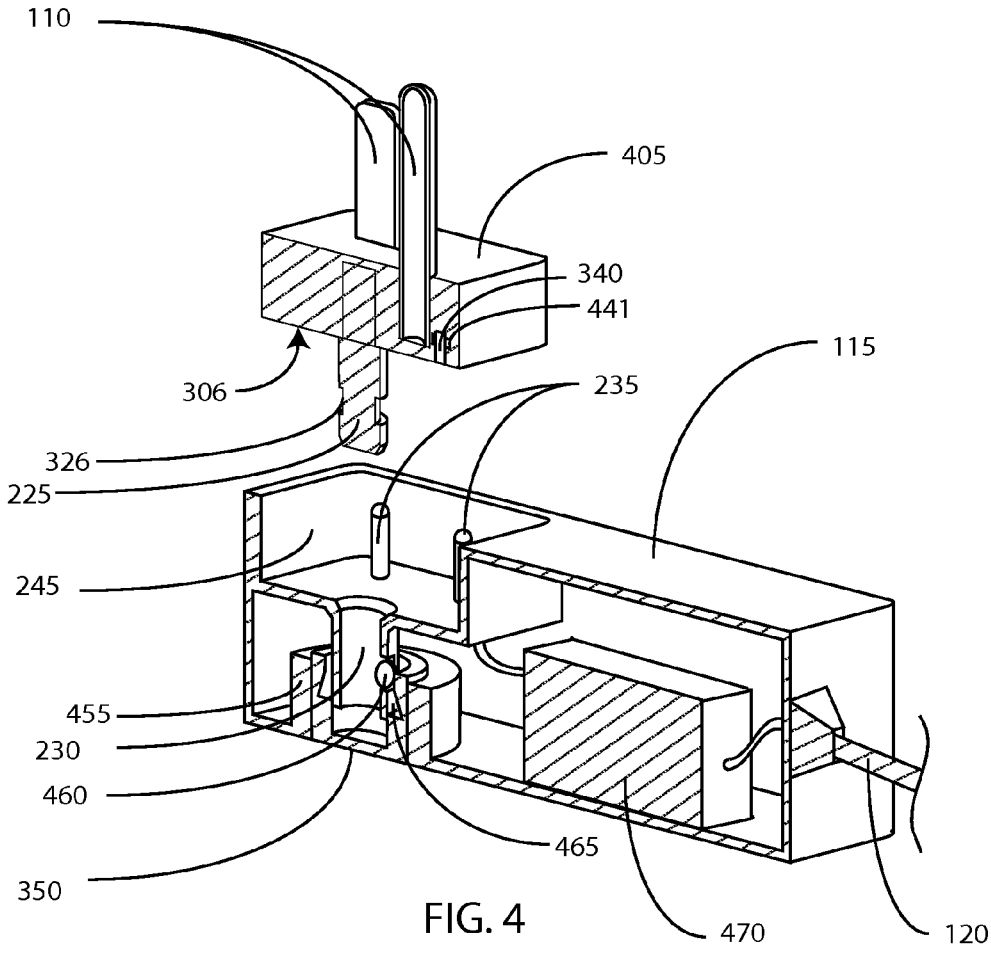
FIG. 4 is a cross section of a power adapter according to an example embodiment of the invention.

FIG. 4 is a cross section of a power adapter according to an example embodiment of the invention. The power adapter 105 can include a power converter 470. The power converter 470 may be for example rectify the alternating current supplied to the power adapter 100 to create a direct current that can be used by electronics such as computing devices. The power converter 470 may also reduce the voltage of the power supplied to the power adapter 105. For example if the power that is received by the power adapter is 110 volt alternating current the output of the power adapter 100 may be 12 v direct current. The power converter may be connected to the receiver connectors 235 and to the cord 120. In one embodiment the power adapter can also be used with 110 volt or 220 volt supplies. The power converter 470 may be able to reduce the 110 volt or the 220 volt to the 12 v in one embodiment or there may be two power converters. If there are two power converters one of the power converters can be used to generate a 12 v output from the 110 volt power supplied and the other power converter can be used to generate a 12 v output from the 220 volt power supplied, for example.

In one embodiment the receiver 115 may include a mechanism to secure the plug module 105 to the receiver 115. The mechanism may include the button 350 that is surrounded by a sleeve 455 in the receiver 115. If the button is activated the button moves within the sleeve 455. The button 350 can surround the opening 230. The side of the opening 230 may have an opening that contains a token 460. The token 460 can extend past the side of the opening into the opening 230. The button 350 can include a notch 465 that allows the token 460 to be received into the notch 465 when the button 350 is activated. If the token 460 is received by the notch 465 then the token may not be extending into the opening 230. If the plug adapter 105 is inserted in the receiver 115 the ground connector 225 may move the token 460 out of the opening 230 and into the notch 465 on the button 350. The token 460 can be received by the fastener 326 on the ground connector 225 if the plug module 105 is connected to the receiver 115. The token 460 can prevent the plug module from being disconnected from the receiver until the button 350 is activated.

In one embodiment the plug module 105 is designed to reduce the possibility that a user is electrocuted if the plug module is plugged into a source without the plug module being connected to the receiver. The plug connectors 110 are not exposed to the first side 306 of the plug adapter 105. The plug adapter can include contacts 441 within the apertures 340 for example. In one embodiment the contacts 441 are not exposed to the first surface of the plug adapter. In one embodiment the apertures 340 have an opening on the first surface 306 that is not large enough to insert a finger of a users hand for example. The opening on the first surface 306 may have a diameter of 2 millimeters for example.

Figure 5:
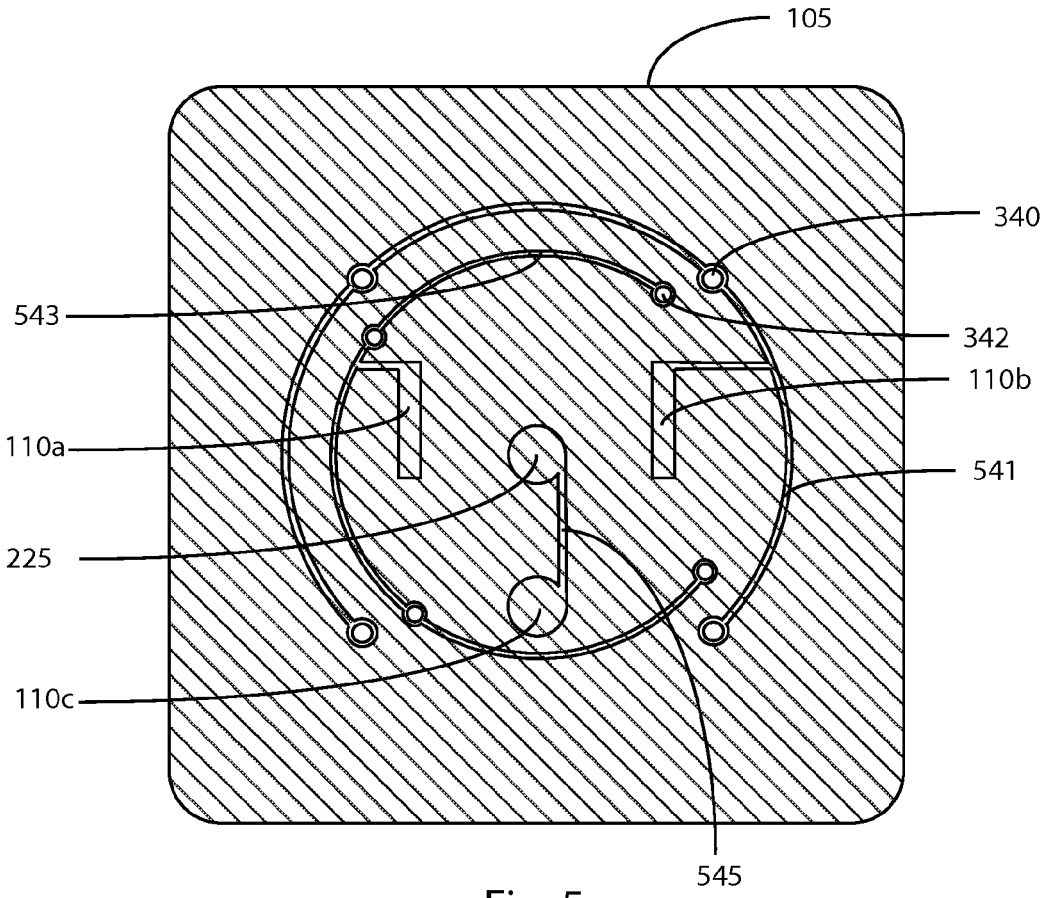
FIG. 5 is a cross section of a plug module according to an example embodiment of the invention.

FIG. 5 is a cross section of a plug module 105 according to an example embodiment of the invention. The plug module 105 can include conductor 541 and 543. If the plug module includes multiple apertures 540 the conductor 541 can connect the apertures 340 to each other and to the plug connector 110*b*. If the plug module includes multiple apertures 342 the conductor 343 can connect the apertures 342 to each other and to the plug connector 110*a*. If a receiver connector on a receiver is inserted into any of the apertures the receiver connector on the receiver is electrically connected to the plug connectors 100*a* or 100*b* through the conductor 541 or 543 respectively. The ground connector 225 can be connected to plug connector 110*c* through a conductor 545.

Figure 6:
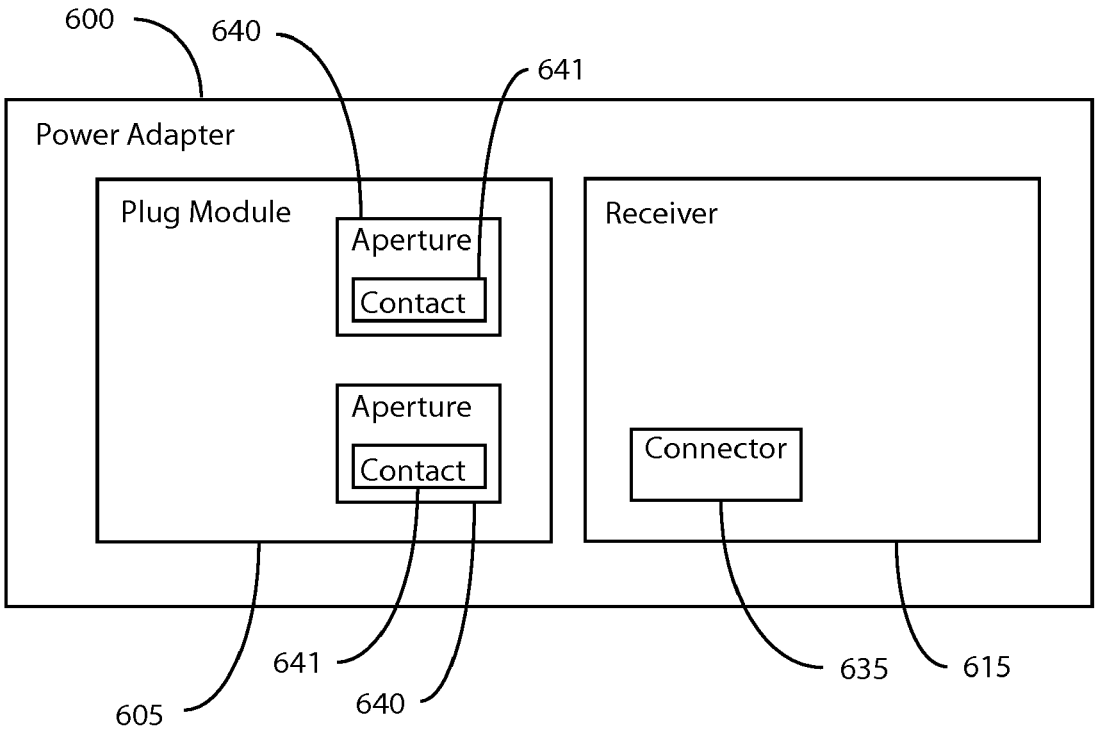
FIG. 6 is a block diagram of a power adapter according to an example embodiment of the invention.

FIG. 6 is a block diagram of a power adapter 600 according to an example embodiment of the invention. The power adapter 600 can include a plug module 605. The plug module 605 can include an aperture 640. In the aperture 640 can be a contact 641. The receiver 615 can include a receiver connector 635. The receiver connector 635 can be electrically connected to the contact 641 if the plug module 605 of the power adapter 600 and the receiver 615 of the power adapter 600 are coupled. The receiver connector 635 can be connected to one of the multiple contacts 641 within multiple apertures 640. In one embodiment the multiple apertures 640 and the contacts 641 that can be connected to the receiver connector 635 are substantially the same distance from a location on the plug module. The location on the plug module can be the axis of rotation of the plug module for example.

In one embodiment a receiver can include a second receiver connector that can connect to second contacts in second apertures. The second contacts in second apertures may each be substantially the same distance from a location on the plug adapter. The axis on the plug module can be the center of the plug module for example. The distance from the axis on the plug module to the aperture or the second apertures can be substantially the same or may be different.

In one embodiment a method can include connecting a plug connector extending from a plug module to multiple contacts within multiple apertures in the plug module. In one embodiment the method can further include connecting a second plug connector extending from the plug module to multiple second contacts within multiple second apertures in the plug module. In one embodiment the method can further include connecting a third plug connector extending from the plug module to a ground connector on the opposite side of the plug module. In one embodiment the method can further include locking the plug module to a receiver with a fastener on the ground connector. If the fastener is on the ground connector a locking mechanism can be included in the receiver. The locking mechanism can lock to the fastener and can include releasing the fastener on the ground connector if a button is activated in one embodiment.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the true spirit and scope of the invention.

What is claimed is:

1. A system comprising:

a receiver to receive a plug module;

the plug module including multiple apertures located substantially the same distance from an axis of rotation of the plug module on a first side of the plug module;

a plug connector on a second side of the plug module opposite the first side, wherein the plug connector is connected to the multiple apertures through a conductor; and a receiver connector extending from the receiver to connect to a contact in one of the multiple apertures of the plug module.

2. The system of claim 1, further comprising a cord extending from the receiver.

3. The system of claim 1, wherein the contact in the aperture is recessed below a surface of the plug module.

4. The system of claim 1, further comprising a rectifier in the receiver.

5. The system of claim 1, further comprising a ground connector on the plug module opposite a plug connector.

6. The system of claim 5, wherein the ground connector includes a fastener.

7. The system of claim 1, wherein the plug module is adapted to be connected to the receiver in multiple orientations, wherein in a first orientation the plug connector is connected to a first aperture of the multiple apertures.

8. The system of claim 7, further comprising a second aperture of the multiple apertures including a second contact connected to connector to allow the plug module to electrically connect to the receiver connector in two orientations.

9. The system of claim 1, further comprising a mechanism to secure the plug module to the receiver.

10. The system of claim 9, further comprising a button on the receiver to release mechanism.

11. The system of claim 10, wherein the mechanism is connected to a ground connector on the plug module.

12. A method comprising:

connecting, electrically, a receiver connector extending from a receiver to one of a multiple contacts within multiple apertures in a plug module, wherein the set of multiple apertures are connected to each other through a conductor; and connecting, electrically, a plug connector extending from a plug module on a side opposite the apertures to multiple contacts within multiple apertures in the plug module.

13. The method of claim 12, further comprising connecting a second connector extending from the plug module to multiple second contacts within multiple second apertures in the plug module.

14. The method of claim 12, further comprising connecting a third connector extending from the plug module to a ground connector on the opposite side of the plug module.

15. The method of claim 14, further comprising locking the plug module to a receiver with a fastener on the ground connector.

16. A system comprising:

a plug module including a ground connector extending from a first side of the plug module;

a plug connector electrically connected to the ground connector, wherein the plug connector extends from a second side of the plug module opposite the first side;

a receiver including an opening to receive the ground connector;

and a mechanism to lock the ground connector of the plug module to the opening of the receiver.

17. The system of claim 16, further comprising a button on the receiver to release the mechanism from the ground connector.

18. The system of claim 16, further comprising a cord connected to the receiver.

19. The system of claim 16, wherein the ground connector is connected to a plug connector on the plug module.

20. The system of claim 19, wherein the ground connector and the plug connector are on opposite sides of the plug module.

* * * * *